United States Patent [19]

Haynes

[11] 4,300,766

[45] Nov. 17, 1981

[54] HOCKEY-TYPE TABLE GAME APPARATUS

[76] Inventor: Joseph E. Haynes, 5945 Merle Dr., Toledo, Ohio 43623

[21] Appl. No.: 98,207

[22] Filed: Nov. 28, 1979

[51] Int. Cl.[3] ..... A63F 7/06; A63F 7/40

[52] U.S. Cl. ..... 273/85 R; 273/126 R; 272/56.5 SS

[58] Field of Search ..... 273/85 R, 85 A, 85 B, 273/85 C, 85 D, 85 E, 85 F, 126 R, 126 A, 128 R, 128 A; 272/56.5 SS

[56] References Cited

U.S. PATENT DOCUMENTS

| | | | |
|---|---|---|---|
| 2,398,726 | 4/1946 | Seguin . | |
| 2,900,189 | 8/1959 | Howlett | 273/126 R |
| 2,966,561 | 12/1960 | Durant | 273/126 A X |
| 3,228,692 | 1/1966 | Brubaker | 273/126 R |
| 3,482,837 | 12/1969 | Myers et al. . | |
| 3,547,749 | 12/1970 | White et al. | 272/56.5 SS X |
| 3,814,417 | 6/1974 | Catlin | 272/56.5 SS |
| 3,817,529 | 6/1974 | Dobbins . | |
| 3,913,918 | 10/1975 | Trachtman . | |
| 3,927,885 | 12/1975 | Crossman et al. . | |
| 3,931,974 | 1/1976 | Goldfarb | 273/126 R |
| 3,944,223 | 3/1976 | Bromwell . | |
| 4,017,079 | 4/1977 | Apellaniz | 273/126 R |

FOREIGN PATENT DOCUMENTS

| | | | |
|---|---|---|---|
| 1200715 | 9/1965 | Fed. Rep. of Germany | 273/126 R |
| 403389 | 9/1909 | France | 273/85 R |
| 1333237 | 6/1963 | France | 273/85 R |
| 698327 | 11/1965 | Italy | 272/56.5 SS |
| 21586 | of 1898 | United Kingdom | 273/85 R |
| 189301 | 11/1922 | United Kingdom | 273/126 R |
| 583689 | 12/1946 | United Kingdom | 273/126 R |

OTHER PUBLICATIONS

Popular Mechanics, vol. 117, #1, 1-1962, p. 137, "Now Its Indoor Skiing".

*Primary Examiner*—Paul E. Shapiro

*Attorney, Agent, or Firm*—Wilson, Fraser, Barker & Clemens

[57] ABSTRACT

The present invention concerns a hockey-type table game apparatus having a strung playing surface, a moveable playing piece and a bat for striking the playing piece. The table includes generally upstanding sides defining the boundaries of the playing surface. The playing surface is formed of a plurality of interwoven strings stretched taut between the table sides. The playing piece is generally cylindrical in shape with a side wall connected to planar upper and lower surfaces by chamfers. The bat includes a handle attached to a body similar in shape to the playing piece. The bat is utilized to strike the playing piece and propel it across the playing surface through an aperture formed in one of the table walls. The playing surface has a small contact area with the playing piece to reduce friction between them.

6 Claims, 4 Drawing Figures

HOCKEY-TYPE TABLE GAME APPARATUS

BACKGROUND OF THE INVENTION

1. Field of the Invention

The present invention relates in general to table games and in particular to a hockey-type table game apparatus.

2. Description of the Prior Art

There are many table-top games which simulate the sport of ice hockey. However, one problem has been to construct a low friction playing surface to increase the distance and speed of travel of the puck. One solution has been to perforate the planar playing surface and form an air chamber beneath it. Then, pressurized air is forced into the chamber to escape through the holes and form an air cushion for the puck. Such a construction is utilized in the popular air hockey games.

However, the air hockey games are relatively expensive, since generally they require an electrically operated air pump and an extra wall to form the chamber with the playing surface. Furthermore, they are difficult to move from place to place since they require an electrical outlet and are relatively heavy due to the air source and the additional parts utilized to form the air chamber.

SUMMARY OF THE INVENTION

The present invention concerns a hockey-type table game including a table having a playing surface, a moveable playing piece and a bat which is utilized to propel the playing piece across the playing surface. The table is typically formed with a frame of upstanding sides defining the boundaries of the playing surface with dimensions approximating commercially available air hockey games. The playing surface is formed of a plurality of interwoven strings stretched taut between opposing sides of the frame. The strings have very little contact area with the playing piece thereby reducing friction.

The playing piece is generally cylindrical in shape with a side wall connected to planar upper and lower surfaces by chamfers. The chamfers reduce the possibility that the playing piece will catch on one of the strings and either stop or reduce in speed as it travels over the playing surface. The bat can be formed with a body similar to the playing piece and an upstanding handle. Typically, opposing side walls of the frame have apertures formed therein for receiving the playing piece whereby a player can score points in the game.

Thus, the present invention overcomes the disadvantages of the prior art devices by being of simple construction and not requiring a separate power source.

It is an object of the present invention to provide a hockey-type table game which is lighter and less expensive than air hockey games.

It is another object of the present invention to provide a hockey-type table game which is relatively lightweight and inexpensive to manufacture.

It is a further object of the present invention to provide a hockey-type table game which is easily portable and does not require an external power source.

DESCRIPTION OF THE PREFERRED EMBODIMENT

Figure 1:
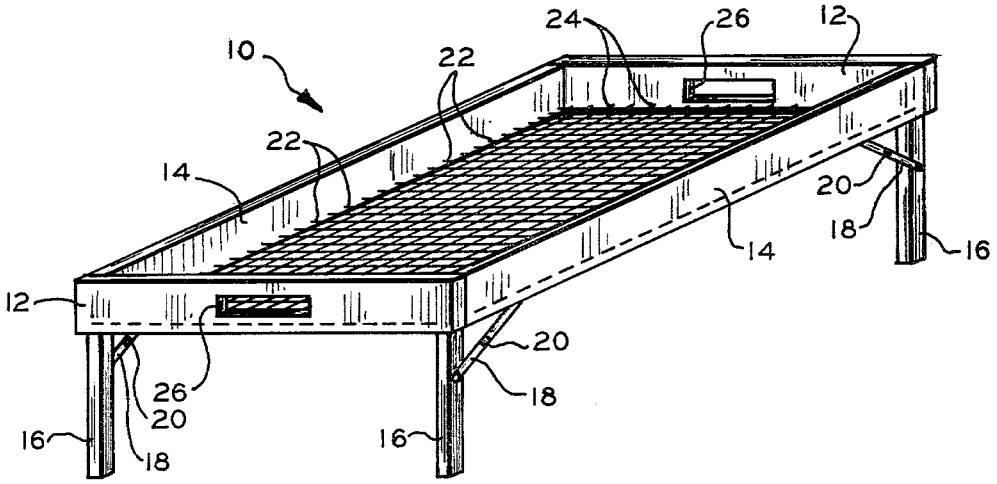
FIG. 1 is a perspective view of a table having a game playing surface formed according to the present invention.

There is shown in FIG. 1 a table game 10 having a playing surface according to the present invention. A frame is formed from a pair of shorter end walls 12 attached to a pair of longer side walls 14 to form a generally rectangular enclosure with upstanding walls defining the boundaries of a playing surface. The frame is supported on a plurality of legs 16, one at each corner, pivotally attached (not shown) to the frame. A plurality of brackets 18 each have one end pivotally connected to a corresponding leg 16 and the other end pivotally connected to the frame. Each bracket is formed of two arms which are pivotally connected at 20 to permit to legs 16 to fold under the frame for storage in a manner similar to many commercially available card tables.

The playing surface is formed from a plurality of reaches of string connected between the opposed sides of the frame and interwoven as in a tennis racquet. A first plurality of strings 22 are connected between the opposed walls 12. A second plurality of strings 24 are connected between the opposed walls 14 and alternately pass over and under adjacent ones of the strings 22 to define spaced intersections where the strings cross.

Each of the end walls 12 has a generally rectangular aperture 26 formed therein for receiving the playing piece. A bottom edge of the aperture 26 is positioned at the upper surface of the playing surface. Although not shown, each aperture 26 could be associated with a suitable receptacle for retaining the playing piece as it leaves the playing surface.

The frame is preferrably formed from a strong material such as wood. Although shown as a rectangle, the frame can be made in any shape in accordance with the objectives of the game. The apertures can be utilized to determine when a point has been scored or targets could be designated on the walls 12 and/or 14. The strings can be made from nylon or a similar material and should be strung taut between the opposed side walls. A single string can be utilized, or a string for each plurality of strings 22 and 24, or a plurality of individual strings each having its ends attached to corresponding walls.

Figure 2:
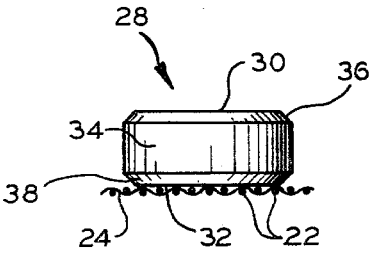
FIG. 2 is an elevational view of a playing piece for use on the table shown in FIG. 1.
Figure 3:
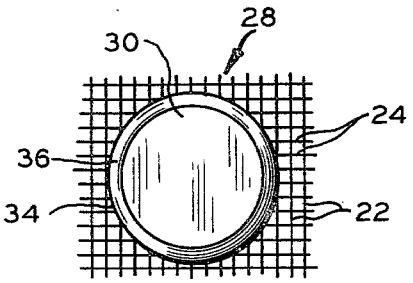
FIG. 3 is a top plan view of the playing piece shown in FIG. 2.

A suitable playing piece 28 is shown in FIGS. 2 and 3. The playing piece 28 is generally cylindrical in shape with opposed upper and lower planar surfaces 30 and 32 respectively and a side wall 34. The upper surface 30 is connected to the side wall 34 by a chamfer 36 and the lower surface 32 is connected to the side wall 34 by a chamfer 38. The playing piece 28 is shown in FIG. 2 with its lower surface 32 resting on the playing surface defined by the strings 22 and 24. As may be seen, the chamfer 38 eliminates the possibility that the playing piece 28 would catch a relatively sharp edge, such as is found on a hockey puck, on one of the strings thereby either deflecting or stopping the playing piece as it moves across the playing surface.

Figure 4:
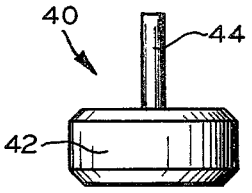
FIG. 4 is a side elevational view of a bat for use on the table shown in FIG. 1.

There is shown in FIG. 4 a bat 40 for use with the table 10 and the playing piece 28. The bat 40 has a body 42 and a generally upstanding handle 44 attached to the upper surface of the body. The player can grasp the handle 44 and move the body 42 across or above the playing surface to strike the playing piece 28. The playing piece will react by sliding across the playing surface until slowed to a stop by friction, or it encounters one of the walls 12 and 14, or it exits through one of the apertures 26.

The playing piece 28 is symetrical in form so that the game does not have to be stopped if the piece 28 turns over. The playing piece 28 can be made from or coated with a material having a relatively low coefficient of friction. The stringed playing surface has very little contact area with the lower surface of the playing piece to further reduce friction. Thus, the playing piece will slide easily across the playing surface.

The body 42 of the bat 40 can be formed with the same shape and size as the playing piece 28. Thus, a playing piece with a handle 44 attached to the upper surface thereof becomes a bat 40. The table 10, the playing piece 28 and the bat 40 can be sized to provide an economical substitute for the air hockey table game.

In accordance with the provisions of the patent statutes, the principle and mode of operation of the invention have been described and illustrated in its preferred embodiment. However, it must be understood that the invention can be practiced otherwise than as specifically illustrated and described without departing from its spirit or scope.

What is claimed is:

1. An apparatus for playing a game comprising: a frame having generally upstanding sides defining boundaries of a playing surface for containing a playing piece a plurality of reaches of string interwoven to define a plurality of spaced intersections, and attached to said upstanding sides and stretched taut in a generally horizontal plane to define said playing surface, a playing piece in sliding contact with said surface at said intersections, and having a generally cylindrical side wall connected to upper and lower opposed planar surfaces by a pair of chamferred surfaces, and a bat having a body for striking said playing piece and a handle attached to said body.

2. The apparatus according to claim 1 wherein said frame is generally rectangular in shape, having two pairs of opposed ones of said sides, each side of one of said pairs of sides having an aperture formed therein for receiving the playing piece.

3. The apparatus according to claim 1 including a plurality of legs extending downwardly from the underside of said frame for supporting said frame and said playing surface.

4. The apparatus according to claim 3 wherein said legs are pivotally attached to said frame for movement to a folded position adjacent said frame.

5. The apparatus according to claim 1 wherein said string is formed from nylon.

6. The apparatus according to claim 1 wherein said body of said bat has a generally cylindrical side wall connected to upper and lower opposed planar surfaces.

* * * * *